US005877790A

United States Patent [19]

Hagiwara et al.

[11] Patent Number: 5,877,790

[45] Date of Patent: Mar. 2, 1999

[54] ELECTROSTATIC INK JET RECORDING APPARATUS EJECTING INK USING DIFFERENT ELECTRIC POTENTIALS APPLIED TO DIFFERENT ELECTRODES

[75] Inventors: Yoshihiro Hagiwara; Ryosuke Uematsu; Junichi Suetsugu; Hitoshi Minemoto; Kazuo Shima, all of Tokyo, Japan

[73] Assignee: NEC Corporation, Tokyo, Japan

[21] Appl. No.: 766,789

[22] Filed: Dec. 13, 1996

[30] Foreign Application Priority Data

Dec. 14, 1995 [JP] Japan ..... 7-325322

[51] Int. Cl.[6] ..... B41J 2/06

[52] U.S. Cl. ..... 347/55

[58] Field of Search ..... 347/13, 14, 55, 347/145

[56] References Cited

U.S. PATENT DOCUMENTS

| | | | |
|---|---|---|---|
| 4,163,980 | 8/1979 | Angelbeck et al. | 347/55 |
| 4,700,204 | 10/1987 | Nakayama | 347/55 |
| 5,600,355 | 2/1997 | Wada | 347/55 |

FOREIGN PATENT DOCUMENTS

| | | | |
|---|---|---|---|
| 59-214053 | 12/1984 | Japan | 347/55 |
| 1-204750 | 8/1989 | Japan | 347/55 |
| 2-67143 | 3/1990 | Japan | 347/55 |
| 93/11866 | 6/1993 | WIPO | 347/55 |

OTHER PUBLICATIONS

Patent Abstracts of Japan, Susumu et al., vol. 005, No. 097 (1981) –56–042663.

*Primary Examiner*—Benjamin R. Fuller
*Assistant Examiner*—C. Dickens
*Attorney, Agent, or Firm*—Foley & Lardner

[57] ABSTRACT

An electrostatic ink jet recording apparatus has a head body having an ink chamber in which ink charged to a specified polarity is stored, a plurality of ink ejection ports and a plurality of ejection electrodes. An ejection electrode drive circuit generates an ejection voltage to drive the plurality of ejection electrodes according to a time division method so that the ejection voltage is not simultaneously supplied to the adjacent ejection electrodes. A plurality of opposite electrodes are opposed to the plurality of ejection electrodes via recording paper. They are separated into first opposite electrodes corresponding to those ejection electrodes which are selectively being driven according to the time division method and second opposite electrodes corresponding to those ejection electrodes which are not being driven according to the time division method. An opposite potential setting circuit sets a first potential for the first opposite electrodes and a second potential for the second opposite electrodes. The first potential is set at such a value as to cause ink ejected from the ink ejection ports to be electrically attracted to the first opposite electrodes more strongly than to the second opposite electrodes.

15 Claims, 4 Drawing Sheets

ELECTROSTATIC INK JET RECORDING APPARATUS EJECTING INK USING DIFFERENT ELECTRIC POTENTIALS APPLIED TO DIFFERENT ELECTRODES

BACKGROUND OF THE INVENTION

1. Field of the Invention

The present invention relates to an ink jet recording apparatus, and in particular, to an electrostatic ink jet recording apparatus that carries out recording using the effects of electric fields to deposit charged toner in ink on a recording medium.

2. Description of the Prior Art

As described in the PCT International Publication Number WO 93/11866, conventional electrostatic ink jet apparatuses have a recording head body with ejection electrodes for ejecting ink and an opposite electrode disposed opposite to the recording head body.

As shown in FIG. 1, a plurality of ejection electrodes 52 are provided at the end of a recording head body 50 so as to protrude therefrom. An opposite electrode 53 is disposed on the extension of the ejection electrodes 52 via a recording medium 58. The plurality of ejection electrodes 52 are arranged in parallel at an interval depending on the recording resolution are immersed in ink. The ink comprises an ink liquid containing charged particulate material (charged toner) and can reach the end of the ejection electrodes due to surface tension. Compared to the plurality of ejection electrodes 52, the opposite electrode 53 comprises a common integral electrode and is grounded.

When a high voltage pulse is applied to any ejection electrode 52, there will be an electric potential difference between the end of the ejection electrode 52 and the opposite electrode 53. Electric fields (electric force lines 63) formed depending on the potential difference cause the ink to be ejected from the end of the ejection electrode 52 toward the opposite electrode 53. The ejected ink deposits on the recording medium 58 disposed in front of the opposite electrode 53 for recording. Compared to the ejection electrode 52, to which the high voltage pulse has been applied, the potential around the ink deposition location on the opposite electrode 53 is uniform. The ink thus flies in the direction in which the distance between the ejection electrode 52 and the opposite electrode 53 is shortest due to the strength of the corresponding electric field, that is, a direction A, and the ink deposits at a location B.

According to this conventional example, however, there is only a small difference in magnitude between the electric field indicated at A and peripheral electric fields (for example, the one indicated at C), so the magnitude of the electric field C may become larger than that of the electric field A if, for example, the surface of the recording paper is rough or dust sticks to the paper. In such a case, the ink, flying along the electric field C, may deposit at a location D, and this deviation of the recording location may cause image quality to be degraded.

SUMMARY OF THE INVENTION

An object of this invention is to eliminate the above disadvantages of conventional examples, and in particular, to provide an electrostatic ink jet recording apparatus that implements stable recording with high definition images.

An electrostatic ink jet recording apparatus according to this invention comprises a head body having an ink chamber in which ink charged to a specified polarity is stored and a plurality of ink ejection ports that are coupled to the ink chamber and from which the ink is ejected; a plurality of ejection electrodes each fixed near the ink ejection port of the head body; an ejection electrode drive circuit that generates an ejection voltage to drive the plurality of ejection electrodes in a time division manner so that the ejection voltage is not simultaneously supplied to the adjacent ejection electrodes; a plurality of opposite electrodes opposed to the plurality of ejection electrodes via recording paper and disposed so as to individually correspond to the ejection electrodes; and an opposite potential setting circuit that separately sets the potential of the plurality of opposite electrodes.

The plurality of opposite electrodes are separated into first opposite electrodes corresponding to those ejection electrodes which are selectively being driven according to the time division manner and second opposite electrodes corresponding to those ejection electrodes which are adjacent to the first opposite electrodes, not being driven according to the time division manner. The opposite potential setting circuit sets a first potential for the first opposite electrodes and a second potential for the second opposite electrodes. The first potential is set at such a value as to cause ink ejected from the ink ejection port to be electrically attracted to the first opposite electrodes more strongly than to the second opposite electrodes.

When the potential difference between the ejection electrode and the opposite electrode to exceed an ejection threshold, the charged ink is ejected from the ejection electrode. The ink flies in the direction along the strongest electric field formed by the ejection electrode and the corresponding opposite electrode, so it reaches at the locations of the first opposite electrodes, which are set at the first potential. Even if any disturbance causes the ink to deviate from its flying direction, the ink is ensured to reach each first opposite electrode after flying along an electric force line extending to this electrode like an arc.

According to an embodiment of this invention, the plurality of opposite electrodes are disposed at the same pitch as the plurality of ejection electrodes. The plurality of opposite electrodes are individually fixed to an insulator.

Furthermore, according to this invention, the opposite potential setting section sets at a second potential the opposite electrodes disposed within a non-recording area not covered by recording paper. Thus, even if any opposite electrode is damaged, incidental current leakage to other metallic portions including the ejection electrodes is effectively prevented.

BRIEF DESCRIPTION OF THE DRAWINGS

This above-mentioned and other objects, features and advantages of this invention will become more apparent by reference to the following detailed description of the invention taken in conjunction with the accompanying drawings, wherein.

DETAILED DESCRIPTION OF THE PREFERRED EMBODIMENTS

Figure 2:
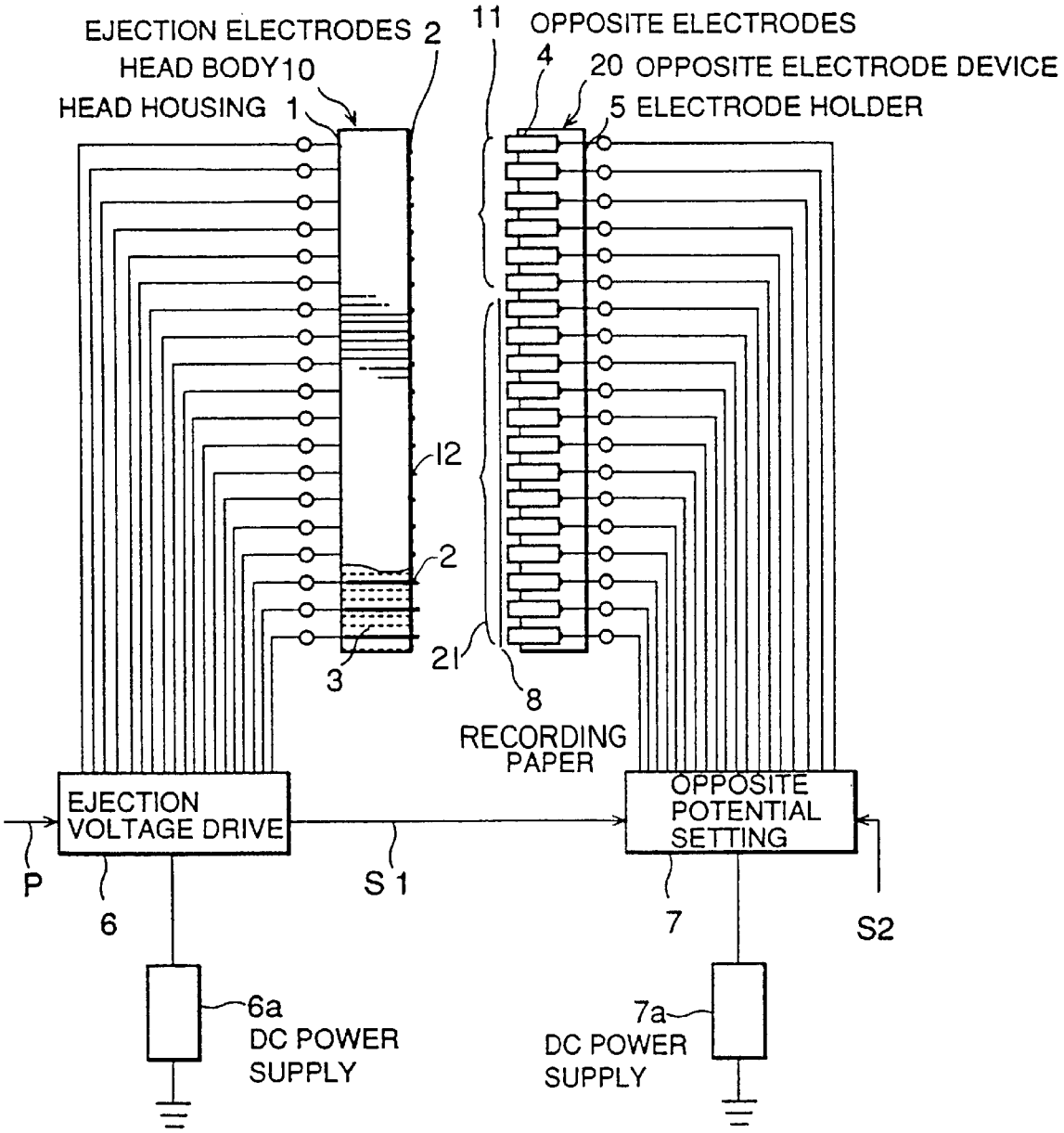
FIG. 2 is a plan view showing an embodiment of an electrostatic ink jet recording apparatus according to this invention.

In FIG. 2, a head body 10 of an electrostatic ink jet recording apparatus has a head housing 1 having an ink chamber 3 therein and a plurality of ejection electrodes 2 disposed in parallel in the head housing 1. The end of the ejection electrode 2 is disposed at an ink ejection port 12 that maintains the ink chamber 3 in communication with the exterior. The ejection electrodes 2 are connected to an ejection electrode drive circuit 6 and are individually driven by an ejection voltage. The ejection voltage is determined by the characteristics of the ink.

The ejection electrode drive circuit 6 drives every other ejection electrode 2 according to a time division method. That is, with a first drive timing, those ejection electrodes which are located at odd number locations in the direction of the array are driven, while with the next drive timing, those ejection electrodes which are located at even number locations are driven. This drive method need not necessarily involve two division driving based on even or odd number driving, but may drive every third ejection electrode or every four ejection electrode. Therefore, two adjacent ejection electrodes are not driven simultaneously.

An opposite electrode device 20 has a plurality of opposite electrodes 4 opposed to the plurality of ejection electrodes 2 via recording paper 8 and an electrode holder 5 that retains the plurality of opposite electrodes 4. Each of the opposite electrodes 4 is disposed on the extension of the ejection electrode 2 so as to correspond to it. That is, the plurality of opposite electrodes 4 are disposed at the same pitch as the plurality of ejection electrodes 2 based on a one-to-one correspondence. The opposite electrodes 4 are connected to an opposite potential setting circuit 7. The potential of the plurality of opposite electrodes 4 is individually set by the opposite potential setting circuit 7.

The opposite potential setting circuit 7 sets a first potential for the opposite electrodes 4 (referred to as "first opposite electrodes") opposed to those ejection electrodes 2 which are selectively being driven according to the time division method (referred to as "first ejection electrodes"), while setting a second potential for the opposed electrodes 4 (referred to as "second opposite electrodes") opposed to those ejection electrodes 2 which are selectively not being driven (referred to as "second ejection electrodes"). For example, during a period in which the ejection electrodes at the even number locations are driven, these ejection electrodes are the first ejection electrodes whereas the ejection electrodes at the odd number locations are the second ejection electrodes. At the same time, the opposed electrodes at the even number locations are the first opposite electrodes whereas the opposed electrodes at the odd number locations are the second opposite electrodes.

The second potential is set so that the potential difference between the first ejection electrodes being driven and the first opposite electrodes is bigger than that between the first ejection electrodes and the second opposite electrodes. If it is assumed that, for example, the ejection voltage is 1,500 V, the first potential is set at 0 V and the second potential is set at 1,000 V. Alternatively, the first potential may be set at −1,000 V and the second potential at 500 V.

As a result, there is a larger electric field strength between the first election electrodes and the first opposite electrodes, so ink ejected from the ink ejection ports of the first ejection electrodes is attracted to the first opposite electrodes more strongly than to the second opposite electrodes.

According to this embodiment, the head housing 1 of the head body 10 is formed of a dielectric material, and the liquid ink is supplied to the ink chamber 3 in the head housing 1 from an ink supply device (not shown). The plurality of ejection electrodes 2 are formed of a conductive material such as Cu or Ni like a band along the ink ejection direction. Each ejection electrode 2 has a smoothly arcuate end that is disposed so as to somewhat protrude from the head housing 1 in the ink ejection direction. The end of the ejection electrode 2 need not necessarily protrude from the head housing 1 if the structure of the ink ejection port 12 is modified.

The ink filled in the ink chamber 3 comprise thermoplastic resin particulates colored with a charging control agent, that is, charged toner, which is then distributed in a petroleum organic solvent (isoparaffin). The charged toner is charged to a straight polarity, using potential.

The plurality of opposite electrodes 4 are formed of a conductive material such as Cu or Ni as in the ejection electrodes 2. The plurality of opposite electrodes 4 are spaced at a certain pitch (for example, about 300 dpi) depending on the recording resolution, but the ejection electrodes 2 need not necessarily be spaced at a pitch depending on the recording resolution, as in this embodiment. In addition, the opposite electrodes 4 are insulated from one another by the electrode holder 5. Furthermore, insulating covering is applied to the surface of the opposite electrodes 4.

The ejection electrode drive circuit 6 is connected to a DC power supply 6*a* to supply the ejection electrodes 2 with a pulse of an ejection voltage of an amplitude depending on the output of the power supply, based on a recording signal P. The pulse of an ejection voltage has the same polarity as the charged toner in the ink, and is applied to those ejection electrodes which are located at either the odd or the even number locations. The ejection electrode drive circuit 6 also has a function of generating drive information S1 on the driving of the ejection electrodes 2 and communicating it to the opposite potential setting circuit 7. The drive information S1 represents how each ejection electrode 2 is driven according to the time division method, and for example, has a value of "1" for those electrodes which are being driven according to the time division method and "0" for those which are not being driven.

The opposite potential setting circuit 7 is connected to a DC power supply 7*a*. The DC power supply 7*a* serves to set the opposite electrodes 4 at the first or the second potential. On receiving drive information S1 from the ejection electrode drive circuit 6, the opposite potential setting circuit 7 identifies the first opposite electrodes corresponding to those ejection electrodes 2 which are being driven according to the time division method (the first ejection electrodes), based on the drive information S1, to set them at the first potential. The first potential should be preset so that the potential difference between the first potential and the voltage in the ejection voltage pulse will exceed the charged toner ejection threshold.

In addition, the opposite potential setting circuit 7 sets at a second potential the second opposite electrodes corresponding to those ejection electrodes 2 which are not being driven according to the time division method (the second ejection electrodes). The potential of the second opposite electrodes is desirably maintained at such a value as to prevent ink from being ejected from the first ejection electrodes to which the ejection voltage is being applied.

The width of the recording paper 8 disposed between the ejection electrodes 2 and the opposite electrodes 4 is predetected by an optical sensor, which generates a paper width signal S2 representing the width. This signal S2 is then supplied to the opposite potential setting circuit 7. The width of the recording paper 8 may be detected, for example, before the recording paper 8 reaches the recording location between the head body 10 and the opposite electrodes device 20. As shown in FIG. 2, within the plurality of opposite electrodes 4, the area covered by the recording paper 8 is referred to as a recording area 21, while the area not covered by the recording paper 8 is referred to as a non-recording area 11. The opposite potential setting circuit 7 sets at the second potential those opposite electrodes 4 which are disposed within the non-recording area 11. This ensures that ink from the ink ejection port 12 of the head body 10 is prevented from incidentally reaching any area of the recording paper 8 for which recording need not be executed. In addition, even if any opposite electrode 4 is damaged, incidental current leakage to other metallic portions including the ejection electrodes 2 can be effectively prevented.

Figure 1:
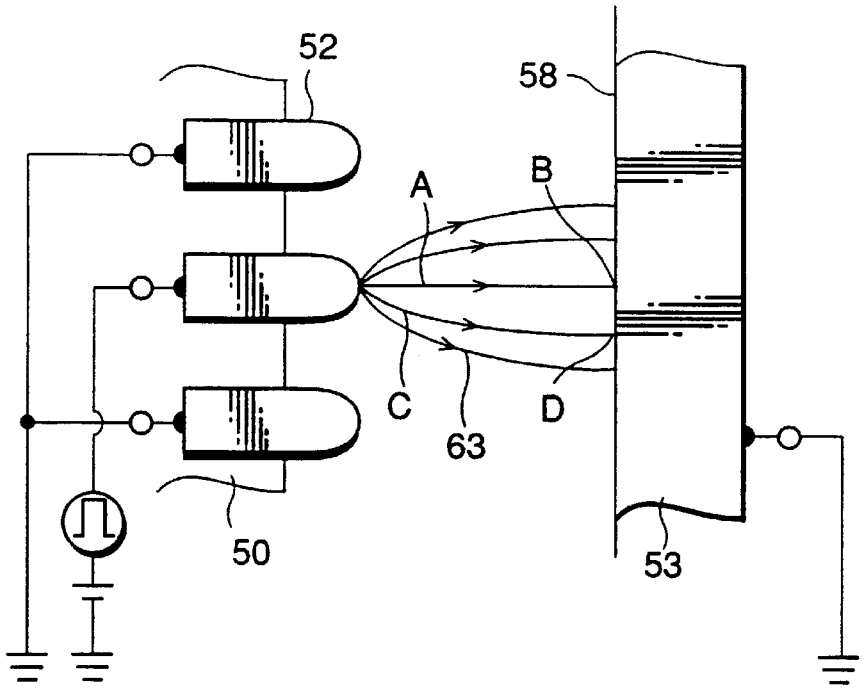
FIG.1 PRIOR ART
FIG. 1 is a schematic plan view of a conventional electrostatic ink jet recording apparatus.
Figure 3:
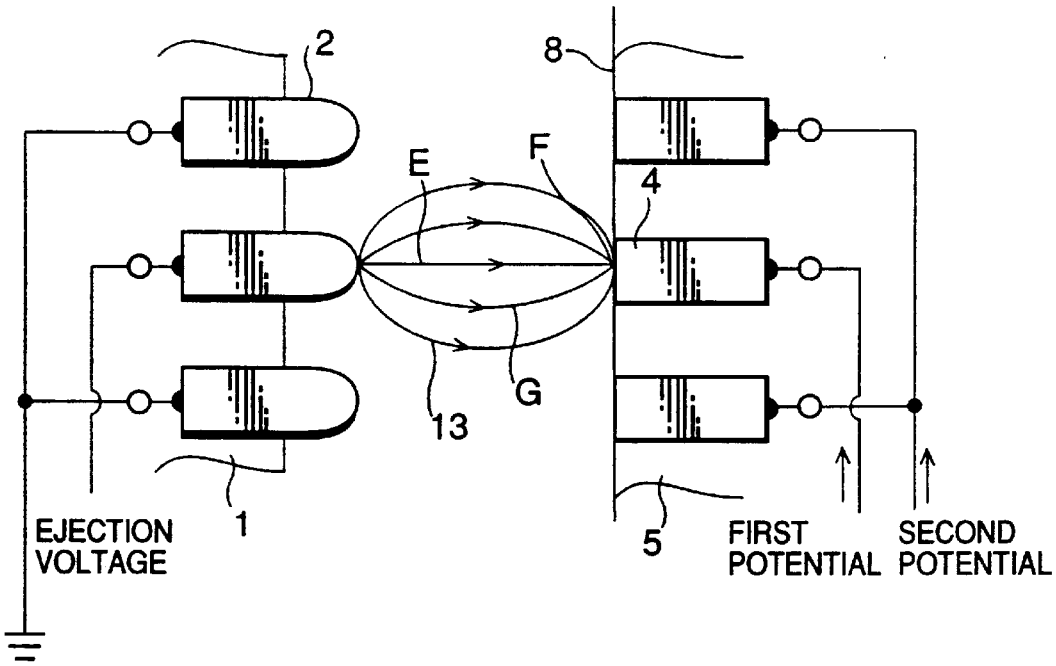
FIG. 3 is a schematic plan view showing an ink ejection operation in the electrostatic ink jet recording apparatus in FIG. 2.

The overall operation of the above embodiment is described with reference to FIGS. 2 and 3.

When ink is held in the ink chamber 3, the end of the ejection electrode 2 near the ink ejection port 12 is wetted with ink, and ink meniscus is formed at this end. Based on the recording signal P, an ejection voltage of the same polarity from the ejection electrode drive circuit 6 is applied to the ejection electrodes 2 at either the odd or the even number locations. In synchronism with the time division drive timing, the potential of the first opposite electrodes corresponding to the first ejection electrodes is set at the first value, while the potential of the second opposite electrodes and non-recording area 11 is set at the second value. The setting of the first and the second opposite electrodes can be switched between the first potential and the second potential by switching the ejection electrodes 2 to be driven according to a time division method between the odd number locations and the even number locations.

When the potential difference between the first ejection electrodes and the first opposite electrodes exceeds the ejection threshold, ink containing charged toner is ejected from the ink meniscus formed at the end of the first ejection electrodes. The ejected ink flies in the direction in which the strongest electric field (the electric force line E) is formed as shown in FIG. 3. That is, the ink flies in a force line direction E and reaches a location F on the recording paper 8. Even if any disturbance causes the ink to fly in a force line direction G instead of the normal direction, the ink containing charged toner is ensured to reach the location F after flying along another electric force line like an arc because the second opposite electrode adjacent to the first opposite electrode 4 at the location F has the second potential. This improves the accuracy with which flying toner reaches the target location, thereby improving image quality particularly in the recording of high resolution images.

According to this embodiment, the first opposite electrode corresponding to the ejection electrode being driven according to the time division method are insulated from the adjacent opposite electrodes (the second opposite electrodes), so leakage to the adjacent electrodes can be prevented even if different pairs of opposite electrodes are set at different potentials.

Furthermore, if the width of the recording paper 8 is smaller than the length of the array of the opposite electrodes 4 in the opposite electrode device 20, the opposite electrodes 4 at both ends or on one side of the recording paper constitute the non-recording area 11 (FIG. 2) not covered by the recording paper 8. Since based on the recording paper width signal S2, the opposite potential setting circuit 7 in FIG. 2 maintains at the second potential the opposite electrodes 4 located within the non-recording area 11, even if any opposite electrode 4 has its film damaged, incidental current leakage to other metallic portions including the ejection electrodes 2 can be prevented.

Figure 4:
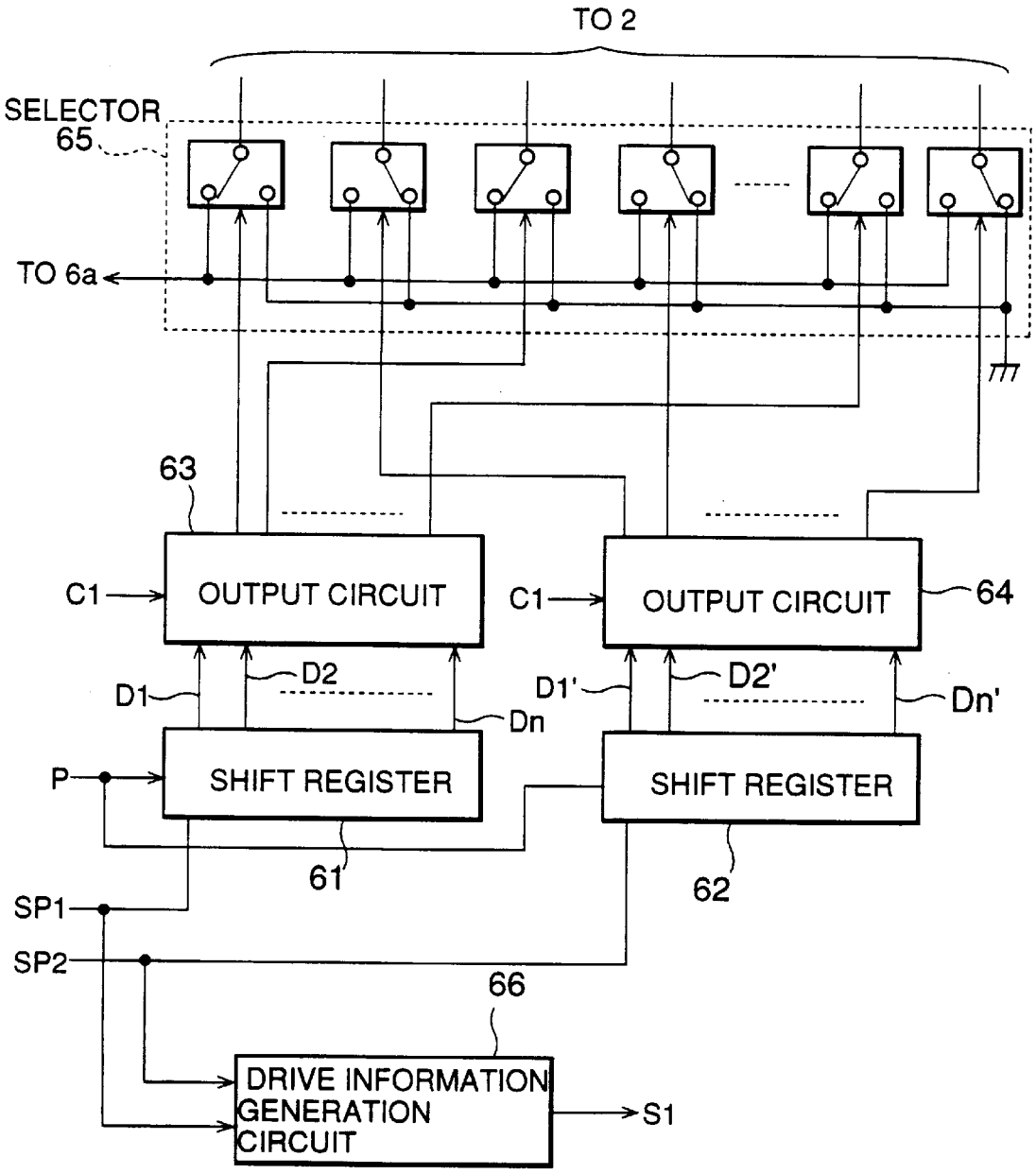
FIG. 4 is a circuit diagram showing an ejection electrode drive circuit in the electrostatic ink jet recording apparatus in FIG. 2.
Figure 5:
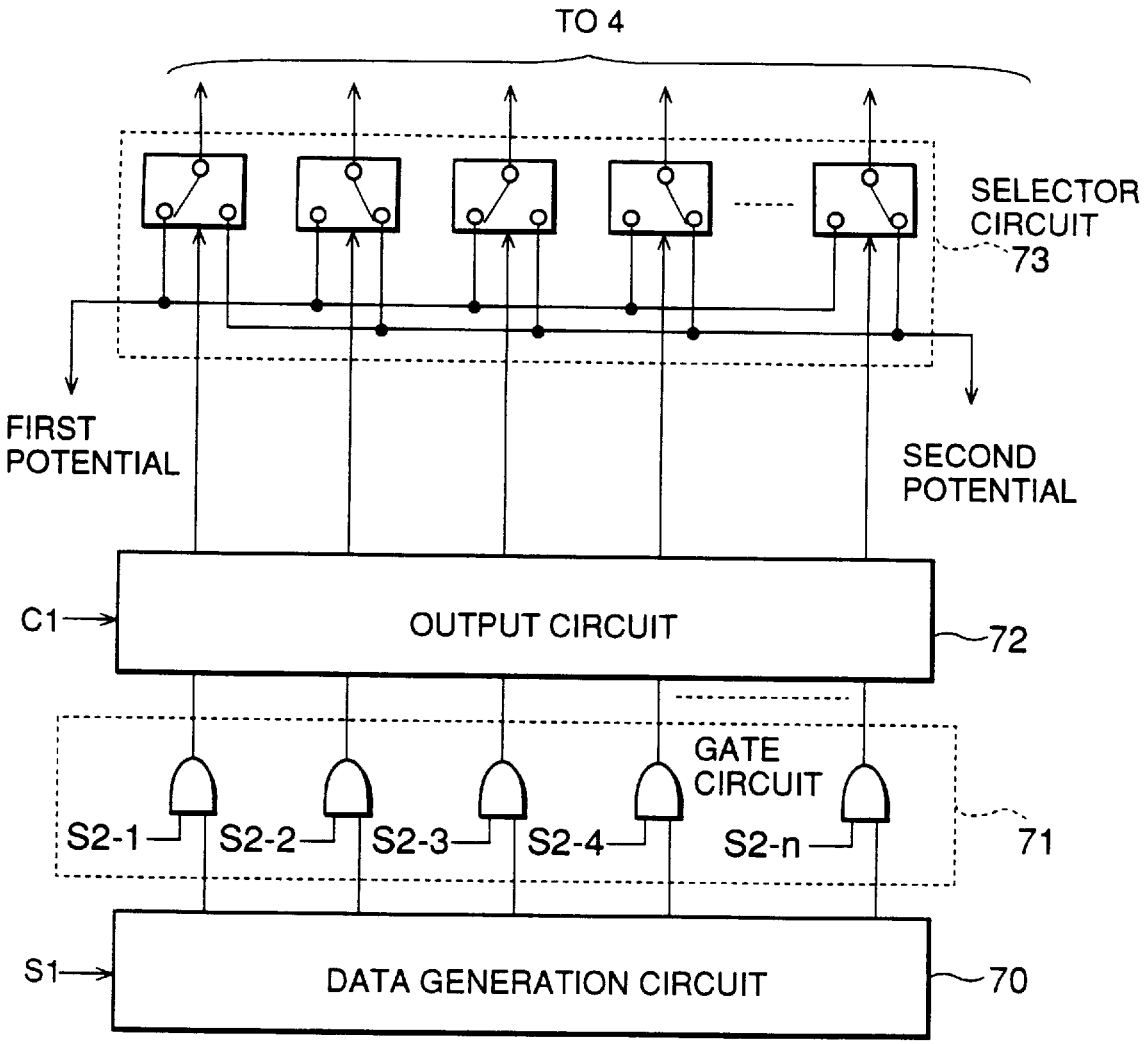
FIG. 5 is a circuit diagram showing an opposite potential setting circuit in the electrostatic ink jet recording apparatus in FIG. 2.

Next, the ejection electrode drive circuit 6 and the opposite potential setting circuit 7 are described in detail in reference to FIGS. 4 and 5.

In FIG. 4, the ejection electrode drive circuit 6 has first and second shift registers 61, 62 for receiving the recording signal P; output circuits 63, 64; a selector circuit 65 for selecting between the ejection voltage from the DC power supply 6*a* and the ground potential as a signal to the plurality of ejection electrodes 2; and a drive information generation circuit 66 for generating the drive information S1.

The recording signal P has an odd number electrode control signal that controls the driving of the ejection electrodes at the odd number locations and an even number electrode control signal that drives the ejection electrodes at the even number locations, and is sequentially generated. Each control signal has a value of "1" if the ejection voltage is to be applied and "0" if it is not to be applied. When odd number electrode control signals are stored in the odd number shift register 61 by a shift pulse SP1, "0" signals are stored in the even number shift register 62 as the even number electrode control signals. On the contrary, when even number electrode control signals are stored in the even number shift register 62 by a shift pulse SP2, "0" signals are stored in the odd number shift register 61 as the odd number electrode control signals.

Odd number electrode control signals D1 to Dn and even number electrode control signals D1' to Dn' from the odd number shift register 61 and the even number shift register 62, respectively, are supplied to the output circuits 63, 64 in parallel. After latching the control signals from the shift registers 61, 62, the output circuits 63, 64 supply pulse signals of a predetermined width to the selector 65 in parallel in synchronism with an output control signal C1. When the signal from the output circuits 63, 64 is "1", the selector 65 selects the output of the DC power supply 6*a* and supplies it to the ejection electrodes 2, whereas when the signal is "0", it selects the ground potential.

Thus, the ejection electrode drive circuit 6 drives the ejection electrodes at the odd number locations at the ejection voltage based on the odd number electrode control signal in the recording signal P, while setting the ejection electrodes at the even numbers at the zero potential. The ejection electrode drive circuit 6 also drives the ejection electrodes at the even numbers at the ejection voltage based on the even number electrode control signal in the recording signal P, while setting the ejection electrodes at the odd numbers at the zero potential.

Based on the shift pulses SP1, SP2, the drive information generation circuit 66 generates the drive information S1 indicating the time division drive condition of the ejection electrodes 2.

In FIG. 5, the opposite potential setting circuit 7 has a data generation circuit 70 operative based on the drive information S1 for generating data "1" or "0" indicating the time division drive condition of each opposite electrode. A gate circuit 71 comprises a plurality of AND gates to which the paper width signal S2 (S2-1 to S2-n) and the output data from the data generation circuit 70 are supplied. An output circuit 72 controls a selector circuit 73. The selector circuit 73 selects between a first potential and a second potential depending on the output from the output circuit 72 to output it to the opposite electrodes 4 simultaneously. The first potential is 0 V, while the second potential is 1,000 V.

Based on the drive information S1, the data generation circuit 70 generates data "1" for the opposite electrodes at the odd number locations, while simultaneously generating data "0" for the opposite electrodes at the even number locations, when the ejection electrodes at the odd number locations are being driven. The gate circuit 71 allows the output from the data generation circuit 70 to directly pass if the paper width signals S2-1 to S2-n are "1". The paper width signals S2-1 to S2-n are "1" for the opposite electrodes within the recording area 21 of the recording paper 8 in FIG. 2 and "0" for the opposite electrodes within the non-recording area 11. Thus, for the non-recording area 11, data "0" is supplied to the output circuit 72. After latching the parallel data from the gate circuit 71, the output circuit 72 supplies pulse signals of a specified length to the selector 65 in parallel in synchronism with the output control signal C1. The output control signal C1 is the same as the output control signal C1 to the output circuits 63, 64 in FIG. 4. The selector 65 selects the first potential as the potential of the opposite electrodes 4 when the signal from the output circuit 72 is "1", whereas it selects the second potential when this signal is "0".

As described above, the opposite potential setting circuit 7 includes the determination circuit (70, 71, and 72 in FIG. 5) for determining the opposite electrodes to which either the first or the second potential is to be supplied, based on the drive information S1 and the information indicating the size of the recording paper 8 (the paper width signals S2-1 to S2-n), and the circuit (the selector circuit 73) operative based on the output of the determination circuit for supplying the first and the second potentials to the first and the second opposite electrodes, respectively.

Thus, the opposite electrodes 4 are set at the first or the second potential in synchronism with the time division driving of the ejection electrodes 2 in FIG. 4. In addition, the first opposite electrodes, opposed to the first ejection electrodes being driven, are set at the first potential, while the second electrodes, opposed to the second ejection electrodes not being driven, are set at the second potential. Furthermore, within the opposite electrodes 4, those located within the non-recording area 11 not covered by the recording paper 8 are set at the second potential so as to clearly separate this area from the recording area 21.

The data generation circuit 70 in FIG. 5 is supplied with the drive information S1 but may be provided with the recording signal P. In this case, the data generation circuit may comprise a shift register that stores the recording signals P and which outputs them in parallel.

The magnitude and polarity of the ejection voltage depend on the charging characteristic of the charged toner in the ink. The first and the second potentials depend on the magnitude of the ejection voltage.

As described above, this invention provides the opposite electrodes that individually correspond to the plurality of ejection electrodes, and the opposite potential setting circuit sets the first opposite electrodes at the first potential and the second opposite electrodes at the second potential. The first potential is set at such a value as to cause ink ejected from the ink ejection ports to be electrically attracted to the first opposite electrodes more strongly than to the second opposite electrodes. As a result, even if any disturbance causes ink containing charged toner to deviate from its flying direction, the charged toner is ensured to reach the correct location on the recording paper, thereby improving the accuracy with which flying toner reaches the target location and also improving image quality particularly in the recording of high resolution images.

What is claimed is:

1. An electrostatic ink jet recording apparatus comprising:

a head body having an ink chamber in which ink charged to a specified polarity is stored, and having a plurality of ink ejection ports that are coupled to said ink chamber;

a plurality of ejection electrodes, which includes subsets of election electrodes, respectively provided for said plurality of ink ejection ports, each of said ejection electrodes being positioned at one end of said corresponding ink ejection port that is furthest away from said ink chamber;

an opposite electrode device disposed a predetermined distance away from said head body;

a plurality of opposite electrodes, which includes subsets of opposite electrodes, opposed to said plurality of ejection electrodes, said plurality of opposite electrodes being disposed on said opposite electrode device;

an ejection voltage drive unit receiving a recording signal and driving said plurality of ejection electrodes on a time division basis so that when one of said ejection electrodes is driven, all adjacent ones of said ejection electrodes are not driven; and an opposite potential setting unit receiving a drive information signal from said ejection voltage drive unit, and driving said plurality of opposite electrodes on the time division basis, wherein, when a subset of said subsets of said plurality of ejection electrodes that are not adjacent to each other are driven by said ejection voltage drive unit, said subset of said opposite electrodes are driven by said opposite potential setting unit based on said drive information, and wherein a subset of said subsets of said opposite electrodes are collectively opposedly positioned with respect to said subset of said plurality of ejection electrodes.

2. The electrostatic ink jet recording apparatus according to claim 1, wherein, when said subset of said plurality of ejection electrodes are driven by application of a first voltage to said subset of said plurality of ejection electrodes by said ejection voltage drive unit during a first time period, all others of said plurality of ejection electrodes are not driven, wherein said subset of said opposite electrodes are driven by a second voltage that is different enough in voltage from said first voltage so as to provide an attraction of said ink ejected from said subset of said plurality of ejection electrodes towards said subset of said opposite electrodes, and wherein, at a same time that said subset of said opposite electrodes are driven by said second voltage, all others of said opposite electrodes are driven by a third voltage that is closer in value to said first voltage than said second voltage is, whereby said ink ejected from said subset of said plurality of ejection electrodes are attracted more strongly to said subset of said opposite electrodes than to said all others of said opposite electrodes.

3. The electrostatic ink jet recording apparatus according to claim 1, further comprising a recording paper that is disposed between said head body and said opposite electrode device, wherein said opposite potential setting unit determines another subset of said opposite electrodes that have said recording paper positioned thereabove, and wherein said opposite potential setting unit provides said third voltage to said another subset of said opposite electrodes so as to prevent ink ejected from said ejection electrodes to be drawn towards any of said another subset of said opposite electrodes.

4. The electrostatic ink jet recording apparatus according to claim 2, further comprising a recording paper that is disposed between said head body and said opposite electrode device, wherein said opposite potential setting unit determines another subset of said opposite electrodes that have said recording paper positioned thereabove, and wherein said opposite potential setting unit provides said third voltage to said another subset of said opposite electrodes so as to prevent ink ejected from said ejection electrodes to be drawn towards any of said another subset of said opposite electrodes.

5. The electrostatic ink jet recording apparatus according to claim 1, wherein said plurality of opposite electrodes are fixed to an insulator.

6. The electrostatic ink jet recording apparatus according to claim 4, wherein, when another subset of said plurality of ejection electrodes are driven by application of the first voltage to said another subset by said ejection voltage drive unit during a second time period that occurs after said first time period, said subset of said plurality of ejection electrodes are not driven, wherein none of said ejection electrodes in said another subset are in said subset of said plurality of election electrodes; and wherein a third subset of said opposite electrodes which are opposedly positioned with respect to said another subset of said plurality of ejection electrodes are driven by the second voltage so as to provide an attraction of ink ejected from said another subset of said plurality of ejection electrodes towards said third subset of said opposite electrodes during the second time period, and wherein, at a same time that said third subset of said opposite electrodes are driven by the second voltage, said subset of said opposite electrodes are driven by the third voltage, whereby said ink ejected from said another subset of said plurality of ejection electrodes are attracted more strongly to said third subset of said opposite electrodes than to said subset of said opposite electrodes during the second time period.

7. The electrostatic ink jet recording apparatus according to claim 6, wherein said recording paper is fixed in position and non-moving during application of ink to said recording paper during the first and second time periods.

8. The electrostatic ink jet recording apparatus according to claim 4, further comprising a sensing unit configured to sense which of said opposite electrodes have at least a portion of said recording paper disposed directly between a corresponding one of said ejection electrodes.

9. The electrostatic ink jet recording apparatus according to claim 1, wherein said subset of said plurality of election electrodes comprises more than one of said ejection electrodes, and wherein said subset of said plurality of opposite electrodes comprises more than one of said opposite electrodes.

10. An electrostatic ink jet recording apparatus comprising:

a head body having an ink chamber in which ink charged to a specified polarity is stored, and having a plurality of ink ejection ports that are coupled to said ink chamber;

a plurality of ejection electrodes respectively provided for said plurality of ink ejection ports, each of said ejection electrodes being positioned at one end of said corresponding ink ejection port that is furthest away from said ink chamber, said ejection electrodes including at least a first subset of said ejection electrodes, a second subset of said ejection electrodes, and a third subset of said ejection electrodes, wherein said first subset, said second subset and said third subset are interleavedly disposed with respect to each other;

an opposite electrode device disposed a predetermined distance away from said head body;

a plurality of opposite electrodes opposed to said plurality of ejection electrodes, said plurality of opposite electrodes being disposed on said opposite electrode device, said plurality of opposite electrodes including a first subset of said opposite electrodes which are opposedly positioned with respect to said first subset of said ejection electrodes, a second subset of said opposite electrodes which are opposedly positioned with respect to said second subset of said ejection electrodes, and a third subset of said opposite electrodes which are opposedly positioned with respect to said third subset of said ejection electrodes;

an ejection voltage drive unit receiving a recording signal and driving said plurality of ejection electrodes on a time division basis so that when one of said first subset, said second subset and said third subset of said ejection electrodes is driven, the other subsets of said ejection electrodes are not driven; and an opposite potential setting unit receiving a drive information signal from said ejection voltage drive unit, and driving said plurality of opposite electrodes on the time division basis so that when one of said first subset, said second subset and said third subset of said opposite electrodes is driven with a second voltage, the other subsets of said opposite electrodes are driven by a third voltage closer in value to a first voltage than said second voltage is.

11. The electrostatic ink jet recording apparatus according to claim 10, further comprising a recording paper that is disposed between said head body and said opposite electrode holder, wherein said opposite potential setting unit is configured to determine a fourth subset of said opposite electrodes that have said recording paper positioned thereabove, and wherein said opposite potential setting unit provides said third voltage to said fourth subset of said opposite electrodes so as to prevent ink ejected from said ejection electrodes to be drawn towards any of said fourth subset of said opposite electrodes.

12. The electrostatic ink jet recording apparatus according to claim 10, wherein said plurality of opposite electrodes are fixed to an insulator.

13. The electrostatic ink jet recording apparatus according to claim 10, wherein said first subset, said second subset and said third subset of said plurality of ejection electrodes each comprises more than one of said ejection electrodes, and wherein said first subset, said second subset and said third subset of said plurality of opposite electrodes each comprises more than one of said opposite electrodes.

14. A method of injecting ink onto a recording paper disposed between a head body which includes a plurality of ejection electrodes, which includes subsets of ejection electrodes, and an opposite electrode device which includes a plurality of opposite electrodes, which includes subsets of opposite electrodes, that are positioned on a one-to-one basis with respect to said plurality of ejection electrodes, the method comprising the steps of:

a) providing a first signal to drive a subset of said subsets of said plurality of ejection electrodes by a first voltage, while not driving any others of said ejection electrodes, each of said ejection electrodes in said first subset not be directly adjacent to any others of said ejection electrodes in said subset;

b) providing a second signal to drive a subset of said subsets of said opposite electrodes, which are opposedly positioned with respect to said subset of said ejection electrodes, at a same time that said subset of said ejection electrodes are driven, the subset of said opposite electrodes being driven by a second voltage that is different enough in voltage from said first voltage so as to create an electrical attraction of ink ejected from said subset of said ejection electrodes towards a corresponding one of said subset of said opposite electrodes; and c) at the same time the second signal is provided to drive said subset of said opposite electrodes, driving another subset of said opposite electrodes by a third voltage that is closer in voltage to said first voltage than said second voltage is.

15. The method according to claim 14, further comprising the steps of:

d) detecting, as a third subset of said opposite electrodes, which ones of said opposite electrodes have said recording paper disposed between the corresponding ones of said ejection electrodes; and e) driving said third subset of said opposite electrodes by the third voltage irrespective as to whether any of said opposite electrodes in said third subset are also in said subset of said opposite electrodes.

* * * * *